United States Patent [19]

Sauer et al.

[11] 3,948,064

[45] Apr. 6, 1976

[54] SINGLE-TUB AUTOMATIC WASHER

[75] Inventors: Leo H. Sauer; Jack F. Clearman, both of St. Joseph, Mich.

[73] Assignee: Whirlpool Corporation, Benton Harbor, Mich.

[22] Filed: Nov. 25, 1974

[21] Appl. No.: 526,592

[52] U.S. Cl. ..... 68/23.4; 68/23.5; 68/133; 68/207; 68/208; 137/403; 233/21; 233/46

[51] Int. Cl.[2] ..... D06F 23/04; D06F 39/08

[58] Field of Search ..... 68/23.4, 133, 23.5, 195, 68/23.7, 207, 208; 210/369, 372, 373, 374; 233/21, 46; 137/403

[56] References Cited

UNITED STATES PATENTS

| | | | |
|---|---|---|---|
| 1,850,821 | 3/1932 | Wright | 68/208 X |
| 2,331,699 | 10/1943 | Kirby | 68/23.7 |
| 2,615,320 | 10/1952 | Belaieff | 68/208 X |
| 2,899,817 | 8/1959 | Smith | 137/403 X |

*Primary Examiner*—Stanley N. Gilreath
*Assistant Examiner*—Philip R. Coe
*Attorney, Agent, or Firm*—Hill, Gross, Simpson, Van Santen, Steadman, Chiara & Simpson

[57] ABSTRACT

An automatic clothes washing machine of a single-tub construction with water level sensing and liquid extraction features includes scoop conduits arranged symmetrically within the sump chamber of a reversely tapered tub i.e., divergent from top to bottom. Each scoop conduit has an opening in its end adjacent the outer wall of the sump chamber and is connected to a discharge line along the axis of the tub. When the tub spins, liquid is forced radially outwardly and downwardly and exits through the scoop conduit openings into the discharge line while maintaining a dynamic balance of the tub. Liquid level control is regulated by a pressure sensitive valve means communicating with an air dome in an agitator portion of the tub.

11 Claims, 5 Drawing Figures

10
11
12
61
67
68
V
PRESSURE SWITCH
66
13
19
14
20
60
62
62a
63
18
43
25
17
16
21
39
23
41
15
22
24
46a
42
44
32
40
39
41
100
36
37
38
33
47
31
30
50
48
64
65

SINGLE-TUB AUTOMATIC WASHER

BACKGROUND OF THE INVENTION

1. Field of the Invention

This invention relates to automatic clothes washing machines and more particularly to a single tub machine of the vertical axis type.

2. Description of the Prior Art

A single-tub automatic washer capable of extracting liquid from articles within the washing chamber by using a fixed conduit in a sump area of the tub to receive fluid through an open end at the periphery of the sump area is shown in U.S. Pat. No. 2,764,884 wherein a single conduit is employed to direct spinning liquid from the periphery of the sump area to a horizontal rotational axis of a washing machine and to a drain from the machine.

U.S. Pat. No. 2,724,255 also discloses the use of a fixed conduit located at the periphery of a sump area for liquid extraction from a vertical axis automatic washer. A pump impeller is used to force liquid into the end of the conduit, and the conduit communicates to a drain which is not along the tub axis. U.S. Pat. No. 3,138,946 shows liquid escaping through an opening in an outer side wall of a sump area to a drain line.

In U.S. Pat. No. 2,874,559 a pressure sensitive diaphragm is used to sense air pressure within an agitator dome to control water into the tub of a washing machine. U.S. Pat. No. 2,449,634, shows the use of a fluid conduit passing through the bottom of a washing machine tub to a remote pressure valve to control washing machine fluid level.

SUMMARY OF THE INVENTION

In accordance with this invention, an automatic washing machine of the vertical axis type has a single tub which forms a sump chamber beneath a downwardly and outwardly tapered washing chamber. Each of a plurality of scoop conduits symmetrically affixed to a non-rotating discharge line at the axis of rotation of the tub extends to a zone just ·ward of the radial extremity of the sump chamber. Openings in the ends of the scoop conduits receive wash liquid spun by the tub at opposite sides of the sump chamber during the spin cycle of the washing machine. The pressure of the moving liquid moves liquid captured by the conduits through the conduits and out the discharge line to the drain of the washing machine. Since the openings in the scoop conduits are arranged symmetrically or equidistantly about the circumference of the sump chamber, dynamic balance is substantially present with respect to forces arising from the scooping of liquid from the sump chamber during the spin cycle.

It is also a feature of this invention to provide conveniently for washing liquid level control by use of an air dome beneath the agitator portion of the washing machine tub; within the air dome an air tube extends from near the top of the air dome downwardly through the discharge line to a pressure sensing device which operates a water inlet valve, cutting off the flow of inlet water when air pressure within the dome is increased to a predetermined level by the rise of liquid within the tub and dome.

DESCRIPTION OF THE PREFERRED EMBODIMENT

Figure 1:
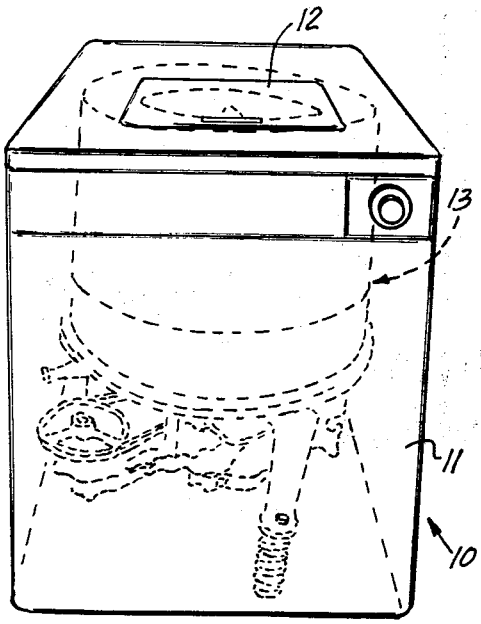
FIG. 1 is a perspective view of a washing machine employing the present invention, with hidden internal parts of the machine shown in broken lines.

Referring to the drawings, a washing machine employing the invention of the present disclosure is shown generally at 10. A generally rectangular cabinet 11 has an access door 12 in the upper surface thereof opening to the interior of a tub 13 in which items to be washed may be placed. The tub 13 is divided horizontally into a washing chamber 14 and a sump chamber 15 therebelow by partitioning means comprising a dividing wall 16 having a perforated portion 17 near the outer periphery of the tub and an air dome wall 18 substantially centrally of the tub. A plurality of agitator vanes 19 are attached to the dividing wall 16 at the air dome wall portion 18. The washing chamber 14 is bounded by tub walls 20 which are tapered downwardly outward, that is, the diameter of the tub is larger at the bottom than at the top, or, the mean diameter of the washing chamber is less than that of the sump chamber. The lower part of the chamber 14 is bounded by a vertical wall 21 formed of a continuation of the material of the tapered wall portion 20. The wall 21 terminates in a radial flange portion 22 which may conveniently be joined by bolts 23 about the periphery thereof in water tight relation to a lower wall 24 enclosing the bottom of the tub 13. The dividing wall 16 is assembled into the tub between the tub bottom wall 24 and a recess 25 about the interior of the wall 21 of the wash chamber 14, thus allowing easy assembly and replacement of the air dome and/or agitator blades as may be necessary or desirable.

The tub assembly is driven through washing and spin cycles by drive means including a motor 30 connected in conventional manner to a drive shaft 31 which is engaged with a center bracket portion 32 of the bottom wall 24 of the tub 13.

Figure 5:
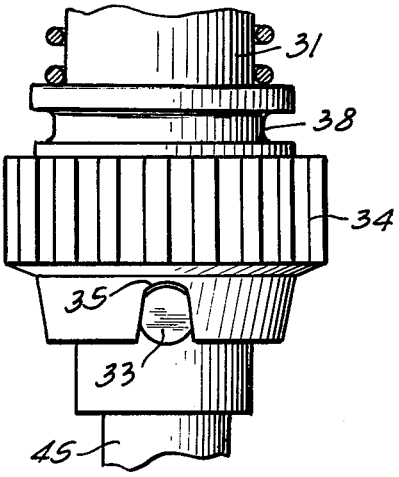
FIG. 5 is a fragmentary elevational view on lines V—V of FIG. 3 of a detail of the tub drive assembly which selectively provides oscillation of the tub for a wash cycle and spinning of the tub for liquid extraction.

For the agitation or wash cycle, the motor 30 drives a dog 33 (see FIG. 5) on the drive shaft 31 by means of a gear 34 having a slot 35 which contacts the dog 33 when the gear 34 is cammed downwardly by an actuating shaft 36 having a finger 37 engaged in a track 38 on the gear.

Figure 2:
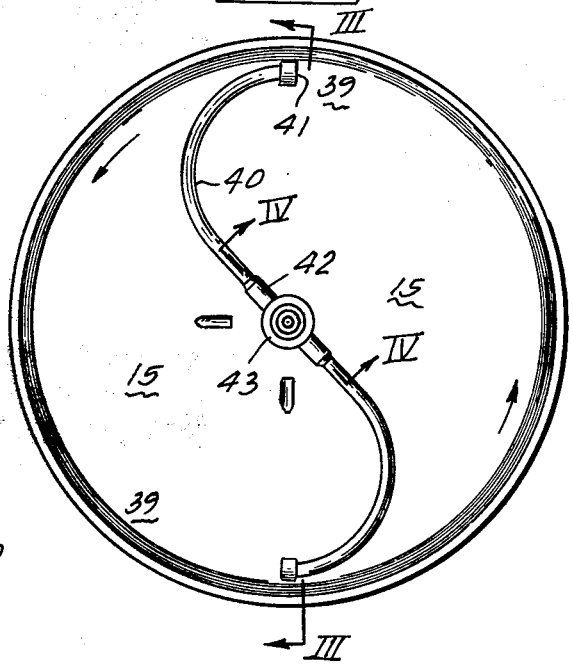
FIG. 2 is a plan view of the scoop conduits of the present invention in the sump chamber of the tub.

In the spin or liquid extraction cycle, the dog 33 is disengaged from the gear 34 so that the gear 34 may spin freely on the shaft 31, and a clutch 100 connects the drive motor 30 with the drive shaft 31 of the tub 13 to rotate the tub 13 at high speed in one direction, such as counterclockwise looking down on the tub, as shown in FIG. 2.

It is contemplated by the present invention that there be provided a plurality of scoop conduits 40, each comprising a hollow, elongated, rigid, cylindrical tubing bent or otherwise shaped into an open hook form or a general "J" shape. The outer end of each scoop conduit is enlarged to form a bell-shaped scoop 41 of larger diameter than the diameter of the conduit tubing. Each scoop 41 occupies a portion of an annular liquid collection zone 39 inward of the periphery of the sump chamber 15 of the tub 13, where the radius of the tub is a maximum and hence where water pressure is greatest during a spin or liquid extraction mode. The respective J shaped tubes 40 when assembled with a connecting block 43 together form an "S" configuration with the inlet scoops 41 disposed at circumferentially opposite sides of the tub.

Figure 4:
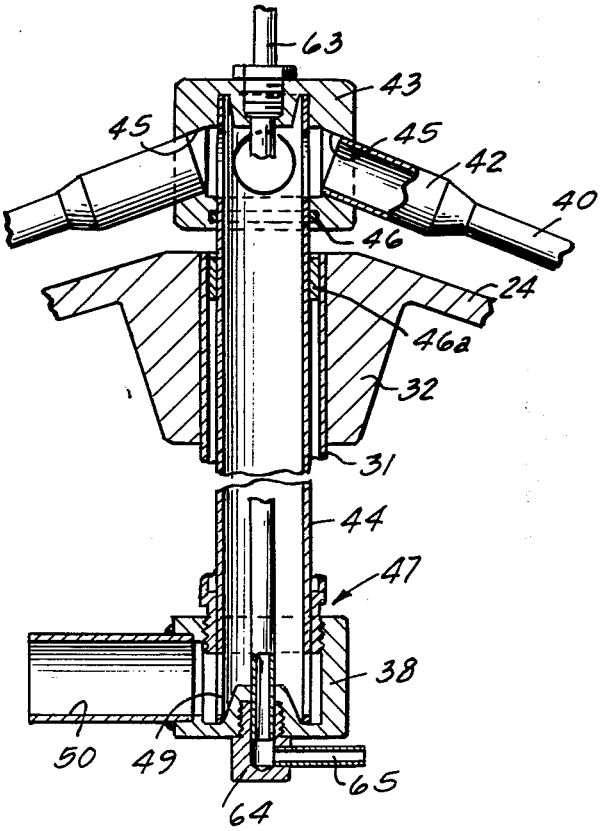
FIG. 4 is an enlarged partial cross-sectional view on lines IV—IV of FIG. 2, of the connection block and related components, showing additional details of the water discharge system, the connections to the block of the scoop conduits, and the passage through the block and discharge system of the air line from the air dome.

An inner end 42 of each of the scoop conduits 40 engages a connection block 43 which sealingly engages the upper end of a liquid discharge tube 44. Each scoop conduit 40 is firmly received in an opening 45 in the connection block and is downwardly inclined thereby to be parallel to the lower wall 24 of the tub 13 (see FIG. 4). The interior of each of the scoop conduits 40 communicates through the opening 45 to the interior of the liquid discharge tube 44. A sealing ring 46 prevents leakage from the interior of the scoop conduits 40 on the discharge tube 44 by way of the lower connection between the connection block 43 and the exterior of the liquid discharge tube 44. The liquid discharge tube 44 is fixed or held to prevent rotation in a lower portion of a tub mounting assembly 47 and is sealed and supported by a second sealing ring **46*a* near the top end of the tub drive shaft 31 and the bracket 32 at the base of the tub 13. The lower portion of the liquid discharge tube 44 is closed by a closure block 48 but opens within the block via a passage 49 to an outlet tube or conduit 50 which leads to a drain from the machine. Thus, sealed and unbroken communication if provided by discharge means from the scoops 41 on the scoop conduits 40 to a drain beyond the outlet tube 50**.

When the tub 13 is spun rapidly in a counterclockwise direction as shown in FIG. 2, wash liquid in the tub will be thrown by centrifugal force against the downwardly outwardly tapered walls 20 of the washing chamber 14 and into the sump chamber 15 through the perforated dividing wall 17. Rotation of the sump chamber 15 will cause the liquid therein to move with the chamber relative to the scoop conduits 40 and the scoops 41 therein. The relative motion will cause liquid to be forced into the interior of the scoop conduits 40 and through the connection block 43 to the discharge tube 44 along the axis of the spinning tub and through the outlet tube 50 to a drain (not shown) without the use of auxiliary pumping means. Since the scoops 41 are arranged radially equidistantly and symmetrically spaced about the periphery of the sump chamber 15, dynamic loads created from interaction between the water and the scoops 41 will be balanced and a substantial advantage provided thereby over the prior art. Liquid from the washing chamber passes through the perforated portion 17 of dividing wall 16 to continuously replace liquid being removed from the sump chamber by the scoop tubes until the entire tub is empty. Clothes in the washing chamber, however, are prevented by the dividing wall from entering the sump chamber.

Although only two scoop conduits 40 have been shown in the drawings, it should be understood that any dynamically balanced combination of scoop conduits could be employed, such as three conduits with their scoops 41 at the points of an equilateral triangel, or four conduits with the scoops 41 being at the corners of a square.

It is a further feature of the invention to provide, in combination with the dynamically balanced discharge scoop conduits in the single-tub washer, a washing liquid inlet control means using an air dome 60 formed beneath the imperforate central portion 18 of the dividing wall 16 between the washing chamber 14 and the sump chamber 15. As water is introduced into the tub 13 from liquid inlet means including inlet device 61 it will first flow through the perforations in the wall 16 into the sump area. Once the sump space has become filled, a liquid level will become established in the washing chamber which will rise until a predetermined level 62 is reached. The water level within the air dome portion 60 will correspond to the liquid level in the washing chamber until the level of the highest perforation in wall 16 is reached, at which point further advance of the liquid level within the air dome 60 will be resisted by the presence of trapped air with that dome. As the water level continues to rise in the washing chamber 14, air inside the air dome 60 will be compressed due to the increasing water pressure on its lower surface **62*a***. This air pressure will vary in proportional relationship to the height of water within the washing chamber, and thus may be used as a controlling variable to regulate the water level.

Figure 3:
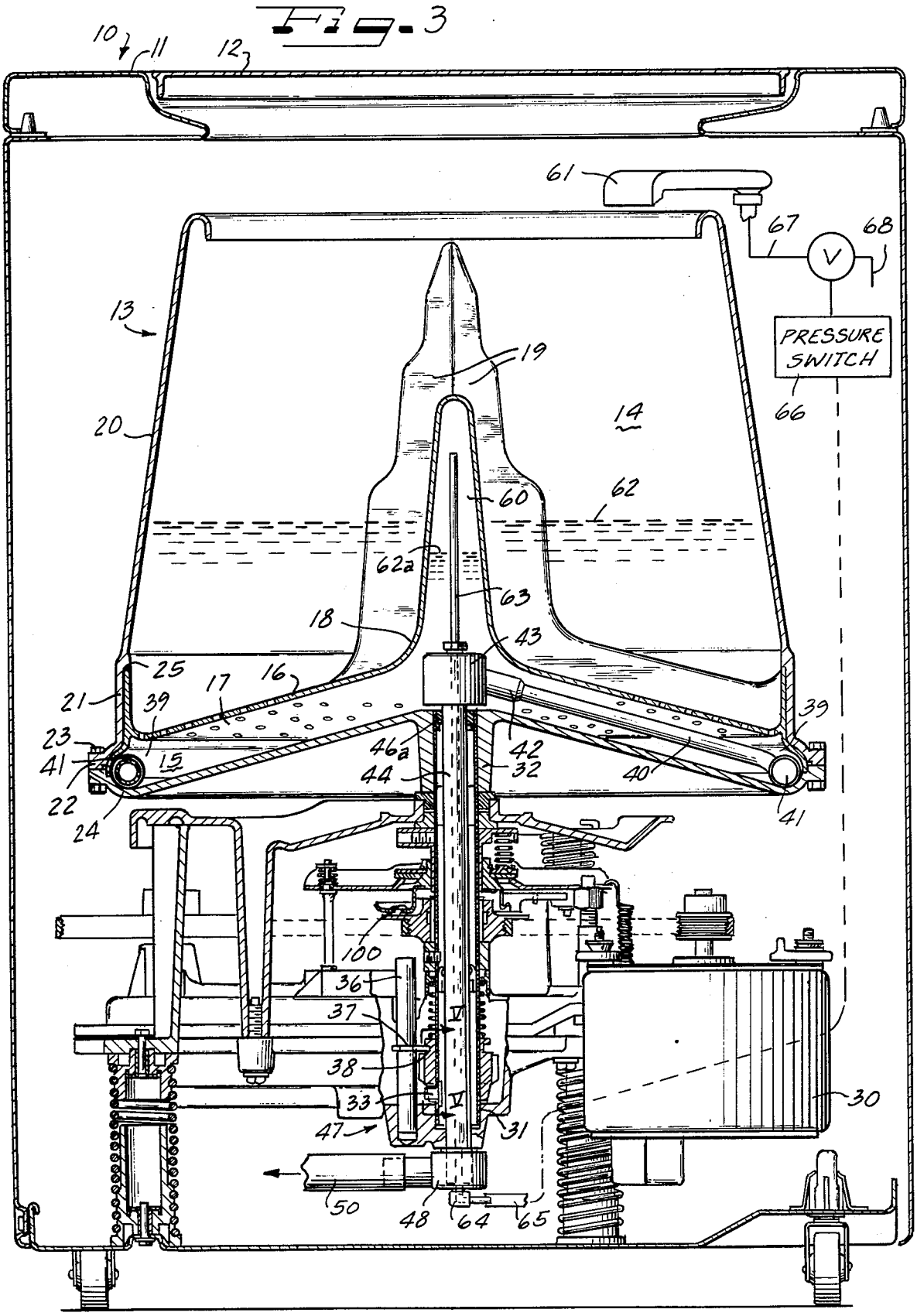
FIG. 3 is a front elevational view partly in cross-section, through the vertical axis of the washing machine, on the orientation of lines III—III of FIG. 2.

A sensing tube of air pressure tap 63 is mounted in air tight relation to the top of the connection block 43 within the sump chamber. The tap 63 extends downwardly through the closure block 48 to a fitting 64 which connects the air pressure tap 63 to a line 65 communicating with a pressure sensing means 66 shown schematically as a pressure switch in FIG. 3. The pressure sensing means 66 and a liquid inlet valve V in a water inlet line 67 between a source of water 68 and the liquid inlet device 61 controlled thereby acts as a control means to shut off the flow of water into the tub when air pressure within the air dome 60 indicates that the water level 62 has been reached within the washing chamber 14.

Although various modifications might be suggested by those versed in the art, it should be understood that we wish to embody within the scope of the patent warranted hereon all such modifications as reasonably and properly come within the scope of our contribution to the art.

Having described the invention, the embodiments of the invention in which an exclusive property or privilege is claimed are defined as follows:

1. An automatic washer comprising:

a tub having circumferentially continuous walls tapering downwardly and outwardly relative to a vertical axis to form an annular liquid collection zone spaced radially outwardly from said axis at a maximum radius of said tub;

partitioning means dividing the interior of said tub into a washing chamber for containing washing liquid and items to be washed and a sump chamber below said washing chamber, and forming an upright center post agitator in said tub;

a drive means for selectively oscillating said tub about its axis during a washing cycle and for spinning said tub about said axis in a direction during a liquid extraction cycle; and liquid extraction means, said liquid extraction means comprising:

a plurality of stationary scoop conduits each having an inner end portion adjacent the axis of said tub and an outer end portion occupying a portion of said annular liquid collection zone of said tub, each said outer end portion having an opening facing in a direction opposite to the direction of rotation of said tub during said liquid extraction cycle, and the openings of said conduits being symmetrically spaced apart about said collection zone; and liquid discharge tube means coaxial with said tub and communicating with said inner end portions of said scoop conduits for discharging liquid from said automatic washer, whereby washing liquid is forced into and through said scoop conduits as said tub spins, to be discharged through said liquid discharge means from said automatic washer, and whereby reaction forces resulting from said liquid extraction are substantially balanced among said plurality of symmetrically spaced scoop conduit openings.

2. An automatic washer as defined in claim 1, further defined by said plurality of conduits being a pair of diametrically opposed scoop conduits having oppositely-facing openings in the outer end portions thereof.

3. An automatic washer as defined in claim 1, and further defined by said agitator within said tub having:

a hollow imperforate center portion about the axis of said tub in fluid communication with said sump chamber and defining an air dome above said sump chamber;

liquid inlet means for introducing liquid to said tub, thereby to isolate and trap a quantity of air in said air dome; and control means for controlling a flow of liquid through said inlet means in response to changes in air pressure within said air dome.

4. An automatic washer as defined in claim 3, wherein said control means comprises:

pressure sensing means for sensing changes in pressure in said air dome; and a liquid inlet valve operated by said pressure sensing means to control said liquid inlet means.

5. An automatic washer comprising:

a tub having circumferentially continuous walls tapering downwardly and outwardly relative to a vertical axis to form an annular liquid collection zone spaced radially outwardly from said axis at a maximum radius of said tub;

partitioning means dividing the interior of said tub into a washing chamber for containing washing liquid and items to be washed and a sump chamber below said washing chamber, and forming an upright center post agitator in said tub;

a drive means for selectively oscillating said tub about its axis during a washing cycle and for spinning said tub about said axis in a direction during a liquid extraction cycle; and liquid extraction means, said liquid extraction means comprising:

a plurality of stationary scoop conduits each having an inner end portion adjacent the axis of said tub and an outer end portion occupying a portion of said annular liquid collection zone of said tub, each said outer end portion having an opening facing in a direction opposite to the direction of rotation of said tub during said liquid extraction cycle, and the openings of said conduits being symmetrically spaced apart about said collection zone; and liquid discharge tube means coaxial with said tub and communicating with said inner end portions of said scoop conduits for discharging liquid from said automatic washer, whereby washing liquid is forced into and through said scoop conduits as said tub spins, to be discharged through said liquid discharge means from said automatic washer, and whereby reaction forces resulting from said liquid extraction are substantially balanced among said plurality of symmetrically spaced scoop conduit openings, said agitator within said tub having:

a hollow imperforate center portion about the axis of said tub in fluid communication with said sump chamber and defining an air dome above said sump chamber;

liquid inlet means for introducing liquid to said tub, thereby to isolate and trap a quantity of air in said air dome; and control means for controlling a flow of liquid through said inlet means in response to changes in air pressure within said air dome;

said control means comprises:

pressure sensing means for sensing changes in pressure in said air dome; and a liquid inlet valve operated by said pressure sensing means to control said liquid inlet means; and the pressure sensing means comprises:

a sensing tube extending through said liquid discharge means and extending upwardly into said air dome;

said sensing tube including an open first end exposed to air pressure within said air dome and a second end in fluid communication with a pressure switch which controls said liquid inlet valve.

6. In an automatic washing machine, a tub and agitator means having a vertical axis and an outer annulus and including a downwardly outwardly tapered tub and partitioning means in said tub dividing said tub into a washing chamber for containing washing liquid and items to be washed and a sump chamber beneath said washing chamber and separated from said washing chamber partly by said partitioning means;

drive means to oscillate said tub and agitator means during a washing cycle and to spin said tub and agitator means during a liquid extraction cycle;

a plurality of stationary scoop conduit means in said sump chamber, each of said conduit means including an inner end portion adjacent the axis of said tub and the conduit means having outer end portions arranged equidistantly apart about an annular liquid collection zone of the tub in said sump, said outer end portions being open and directed to receive liquid during said liquid extraction cycle; and liquid discharge tube means in liquid-receiving relationship with said inner end portions of said scoop conduits for discharging liquid from said tub along the tub axis, whereby washing liquid contained in said tub during said liquid extraction cycle is forced into and through said scoop conduits as said tub spins and is discharged through said liquid discharge tube means from said machine.

7. In an automatic washing machine as defined in claim 6, said tub and agitator means further comprising a single tub open at its top and imperforate about its sides and bottom.

8. In an automatic washing machine of the vertical axis type, a tub having a circumferentially continuous wall tapering downwardly outwardly;

an imperforate center post agitator and a perforate horizontal wall together dividing the interior of the tub into a washing chamber and a sump chamber below said washing chamber; and a plurality of scoop conduits for draining said tub, each comprising a generally J shaped tube having an inlet disposed in an annular liquid collection zone of said sump chamber and an outlet for connection near the tub axis to a discharge tube, the scoop conduits receiving liquid as the tub spins and directing said liquid to said discharge tube.

9. In a washer as defined in claim 8, said imperforate agitator having formed therein an air dome in which air pressure changes as a function of the level of water in said tub; and liquid inlet means responsive to said changes of pressure to regulate the quantity of water introduced to said tub.

10. In a washer as defined in claim 8, two of said J shaped conduits together forming an S shaped array and positioning scoops at diametrically opposite sides of the liquid collection zone to dynamically balance the tub during liquid extraction.

11. In an automatic washing machine as defined in claim 6, said partitioning means comprising an imperforate raised center portion forming a hollow agitator post having an air dome therewithin.

* * * * *